United States Patent [19]

Heumann et al.

[11] 4,043,707

[45] Aug. 23, 1977

[54] SUBMERSIBLE MOTOR-DRIVEN PUMP

[75] Inventors: Anton Heumann; Heinz Weibart, both of Nuremberg, Germany

[73] Assignee: Klein, Schanzlin & Becker Aktiengesellschaft, Frankenthal, Pfalz, Germany

[21] Appl. No.: 621,981

[22] Filed: Oct. 14, 1975

[30] Foreign Application Priority Data

Oct. 15, 1974 Germany ..... 2448540

[51] Int. Cl.[2] ..... F04B 39/14

[52] U.S. Cl. ..... 417/360; 285/27; 285/226; 285/325

[58] Field of Search ..... 417/360; 415/134, 135, 415/201; 285/24, 27, 31, 95, 226, 325; 222/180

[56] References Cited

U.S. PATENT DOCUMENTS

| | | | |
|---|---|---|---|
| 1,534,399 | 4/1925 | Kraft | 285/27 |
| 2,699,959 | 1/1955 | Zallea | 285/226 |
| 2,849,960 | 9/1958 | Olmstead et al. | 415/196 |
| 3,227,475 | 1/1966 | Sinkinson | 285/325 X |
| 3,722,757 | 3/1973 | Dahlgren | 417/360 X |
| 3,880,553 | 4/1975 | Wolford et al. | 417/360 |

FOREIGN PATENT DOCUMENTS

| | | | |
|---|---|---|---|
| 1,231,562 | 12/1966 | Germany | 417/360 |

*Primary Examiner*—William L. Freeh

*Assistant Examiner*—Edward Look

*Attorney, Agent, or Firm*—Michael J. Striker

[57] ABSTRACT

An underwater pumping arrangement includes a submersible pump having a pump outlet conduit provided with a first connecting flange adapted to register with a second connecting flange of an outflow conduit permanently provided at the bottom of a liquid-filled pit or container to form with the second connecting flange a seal-tight conduit joint. As the pump is lowered into the liquid-filled pit or container towards the bottom thereof, it is guided by cables or rails into a predetermined position in which the first connecting flange registers with the second connecting flange. The pump is provided at its underside with a supporting structure for directly supporting the pump upon the bottom of the pit or container when the pump has been lowered into the predetermined position. One of the two conduits is provided with an expandable-contractable connecting chamber connected to one connecting flange. When activated, the expandable-contractable connecting chamber presses the one connecting flange into seal-tight engagement with the other connecting flange to form the seal-tight conduit joint. In this way there is established between the first and second connecting flanges a seal-tight engagement whose effectiveness is not mainly dependent upon the inherent weight of the pump itself.

7 Claims, 3 Drawing Figures

SUBMERSIBLE MOTOR-DRIVEN PUMP

BACKGROUND OF THE INVENTION

The present invention relates to underwater pumping arrangements of the type including a submersible pump having a pump outlet conduit provided with a first connecting flange adapted to register with a second connecting flange of an outflow conduit permanently mounted at the bottom of a liquid-filled pit or container so as to form with the second connecting flange a seal-tight conduit joint, and being of the type in which the pump as it is lowered into the liquid-filled pit or container towards the bottom thereof is guided by guiding means, such as guide rails and/or cables, into a predetermined position in which the first connecting flange registers with the second connecting flange.

Submersible pump arrangements of this general type are known in a great variety of forms and designs. Likewise, the establishment of the seal-tight connection between the first and second connecting flanges, of the pump outlet conduit and of the permanently installed outflow conduit, respectively, can be effected in a great variety of known ways. However, despite the variety in the structural designs and in the procedures for establishing the seal-tight conduit joint, all the known structures and connecting procedures make use of a single principle: the force which is employed to press the first and second connecting flanges together to form the conduit joint is derived, in one way or another, from the inherent weight of the structure of the pump itself.

Federal Republic of Germany patent DT-PS No. 1,061,622 discloses one submersible pump arrangement of the type in question. In this arrangement, the first and second connecting flanges are each disposed at an acute angle relative to a vertical plane, with such an orientation that the inclined connecting flanges diverge from each other in downwards direction. Located intermediate the connecting flanges is a connecting member having correspondingly inclined flanges. The pump structure, after being lowered into position on the connecting member by means of vertically disposed guide rails, sits on the connecting member. Due to the inclined disposition of the flanges just mentioned, the weight of the pump structure itself maintains a seal-tight connection between the flange of the pump structure and of the connecting piece, in this way establishing the requisite conduit joint.

Federal Republic of Germany patent DT-PS No. 1,187,931 discloses a similar connecting expedient. To avoid the use of inclined connecting flanges, the lowering of the pump structure into the predetermined position relative to the outflow conduit structure is accomplished using a guide rail which at its lower end is inclined towards the outflow conduit structure. The pump structure is provided with guide rollers which ride upon the guide rail. As the pump structure rides along the vertical, upper portion of the guide rail, the pump structure is lowered vertically; as the pump structure continues to ride further down upon the inclined lower portion of the guide rail it is constrained to move into tight engagement with the outflow conduit structure. However, the constraining force, although directed by the inclined portion of the guide rail, is ultimately derived from the weight of the pump structure itself.

Federal Republic of Germany patent DT-PS No. 1,231,562 discloses another such submersible pump arrangement. In that arrangement, to establish the requisite seal-tight conduit joint, use is made of a mounting claw provided in the region of one of the connecting flanges and an engagement member provided in the region of the other connecting flange and adapted to be hooked over by the claw. The engagement member is formed as a resilient flexible rod. As the pump structure is lowered into place, under the control of guide cables, or the like, the claw hooks cover the engagement member. The resilient engagement member is caused to undergo a certain amount of stressing such that the upper edge of the connecting flange of the pump structure is pulled into seal-tight engagement with the connecting flange of the outflow conduit structure. Because of the resilience of the engagement member, manufacturing tolerances are not particularly critical in ensuring a reliable establishment of a seal-tight conduit joint. However, as before, the force which presses one connecting flange against the other is derived from the inherent weight of the pump structure itself, which is unsupported except at the end thereof provided with the connecting flange. When the force employed to establish and maintain the seal-tight connection is derived from the inherent weight of the pump structure itself, important disadvantages result. Firstly, the connecting flanges and neighboring structure are subjected to the heavy loading associated with the often very considerable weight of the pump structure. As a result, the known procedures for establishing the conduit joint can be employed only up to a certain maximum weight of the pump structure, because otherwise the connecting flanges will have to be excessively massive and strong. Accordingly, if the pump structure is of considerable weight, it would seem desirable to support the pump structure directly upon the bottom of the liquid-filled container or pit. However, this of course means that the inherent weight of the pump structure will no longer be available for the establishment and maintenance of the seal-tight conduit joint.

Federal Republic of Germany allowed patent application DT-AS No. 1,653,431 discloses an underwater pumping arrangement in which the outflow conduit structure is permanently mounted at the bottom of the liquid-filled pit or container and in which the pump structure is supported on a saddle structure which in turn is directly supported on the bottom of the pit or container. To establish the seal-tight conduit joint between the first and second connecting flanges, use is made of a wedge-like connecting conduit structure which is forced in between the first and second connecting flanges. The forcing in of the wedge-like connecting structure is accomplished from above using a threaded-rod drive. All this additional structure is expensive and undesirable in itself. Furthermore, however, it necessitates insertion and removal of the wedge-like connecting structure by manual operation; i.e., the seal-tight conduit joint is not automatically established without a separate manual operation. Also, the requirement for a threaded-rod drive is disadvantageous per se, since the pits into which such pump structures are lowered may be as deep as 80 meters.

Summary of the Invention

It is accordingly a general object of the invention to provide an underwater pumping arrangement so designed that the force employed to establish and maintain the seal-tight conduit joint is not derived, or at least not mainly derived, from the inherent weight of the pump structure itself.

It is another object of the invention to provide an underwater pumping arrangement so designed that the seal-tight conduit joint is established automatically upon activation of the pump, without the need for separate connecting steps requiring manual operations or separate initiation.

These objects, and others which will become clear from the description, below, of preferred embodiments, can be met, according to one advantageous concept of the invention, by, firstly, using a supporting structure at the underside of the pump for directly supporting the pump upon the bottom of the liquid-filled pit or container when the pump has been lowered into the predetermined position and, secondly, by providing either the pump outlet conduit or the permanently mounted outflow conduit with an expandable-contractable connecting chamber connected to one connecting flange and activatable for pressing the one connecting flange into seal-tight engagement with the other connecting flange to form the seal-tight conduit joint. By virtue of the provision of the expandable-contractable connecting chamber and the supporting means, there is established between the first and second connecting flanges a seal-tight engagement whose effectiveness is not dependent, or at least not mainly dependent, upon the inherent weight of the pump itself.

Advantageously, the expandable-contractable connecting chamber is a connecting bellows connected to one connecting flange and automatically operative in response to the force of the pressure generated by the pump when the pump is activated for pressing the one connecting flange against the other connecting flange to form the seal-tight conduit joint. In this way, no manual operation or separate activating step is required to establish the seal-tight conduit joint. The conduit joint is automatically established each time that the pump is deactivated.

The invention represents an improvement over the known ways of automatically establishing the conduit joint in that no reliance need be placed upon the inherent weight of the pump structure, which need be only as light or only as heavy as actually required for pumping purposes. Likewise, the use of an automatically activated expandable-contractable connecting chamber makes it possible to eliminate the need for separate means for remotely controlling the establishment of the conduit joint.

According to one advantageous concept of the invention, the expandable-contractable connecting chamber is a connecting bellows which assumes a certain installed-condition length when the connecting chamber is activated and maintains the connecting flanges pressed together. The connecting bellows is connected at one end to one of the connecting flanges and at its other end to an additional flange connected to the conduit provided with the connecting bellows. Compression springs located intermediate the one connecting flange and the additional flange normally urge the one connecting flange in direction towards the other connecting flange, and the compression springs are operative, when the pump is not yet in the predetermined position, for urging the connecting bellows into a position in which its length exceeds the installed-condition length by a small predetermined distance. Furthermore, the lower peripheral portion of the first connecting flange and the upper peripheral portion of the second connecting flange are complementarily chamfered. Thus, when the pump is lowered into the predetermined position, the chamfered portions engage each other so that the one connecting flange is pushed back against the force of the compression springs by the other connection flange. This makes for a non-abrupt establishment of the conduit joint, and furthermore has the effect of causing the facing surfaces of the connecting flanges to rub each other clean as they slide relative to each other into the position of register.

When the expandable-contractable connecting chamber is activated and presses together the first and second connecting flanges, connected to the pump outlet conduit and the permanently installed outflow conduit, respectively, the connecting chamber may also tend to push the pump structure away from the outflow conduit structure. This can be counteracted by the use of holding means operative for holding together the pump structure and the outflow conduit structure during the establishment and maintenance of the seal-tight conduit joint. Such conduit structure could, for example, include a holding claw connected to one of the conduits and a cooperating engagement member connected to the other of the conduits. The holding claw can fit over the engagement member, thereby holding the conduits together during the establishment of the conduit joint, and counteracting the effect of the reaction force which develops during such establishment.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

Figure 2:
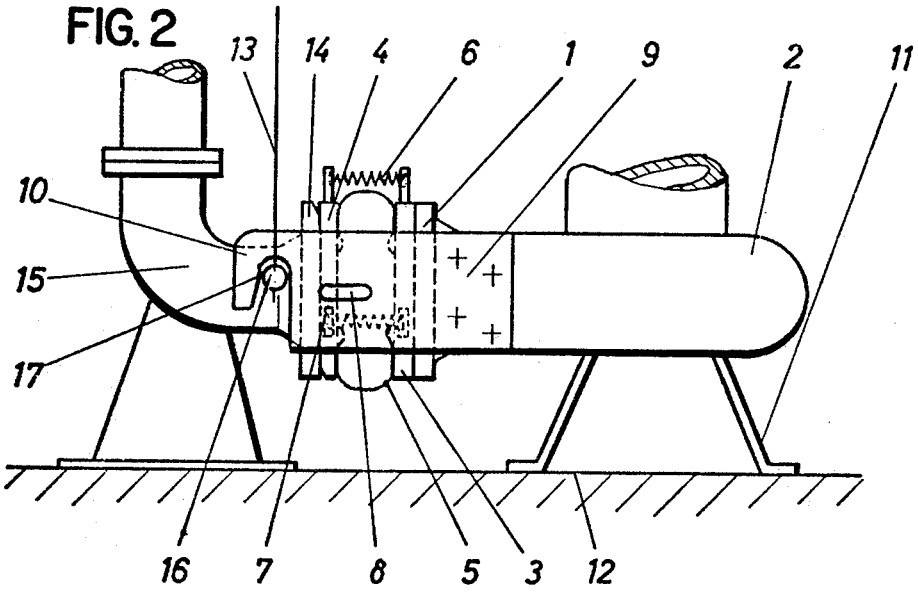
FIG. 2 depicts the pump after it has been lowered into the predetermined position.

DESCRIPTION OF THE PREFERRED EMBODIMENTS:

In FIG. 2, numeral 2 designates generally the structure of a motor-driven pump. The pump 2 is provided with supporting means 11, located at the underside of the pump 2, for supporting the pump 2 directly upon the bottom 12 of the liquid-filled pit or container, after the pump 2 has been lowered into the predetermined position. A set of guide cables 13 (one shown) serves to guide the pump 2 as it is being lowered into the predetermined position.

Permanently mounted on the bottom of the liquid-filled pit or container is an outflow conduit structure 15. Outflow conduit 15 is provided with a connecting flange 14 and with an engagement member 16.

The outlet conduit of pump 2 is provided with a pair of spaced-apart connecting plates 9 each having end claws 10. When the pump 2 is lowered into the predetermined position, the claws 10 hook over the engagement members 16, with the inner surfaces 17 of claws 10 contacting the engagement members. Plates 9 with claws 10 and engagement members 16 together form holding means for providing a reaction force whose purpose is described below.

The outlet conduit of pump 2 is furthermore provided with a pressure flange 1. Connected to the pressure flange 1 is an expandable-contractable connecting chamber shown separately in FIG. 3. In the illustrated embodiment, the expandable-contractable connecting chamber is a bellows-type connecting chamber. The bellows-type connecting chamber is comprised of a flange 3 connected to the pressure flange 1, a connecting flange adapted to register with the connecting flange 14 of the outflow conduit structure 15, a bellows 5 seal-tightly connected intermediate the flanges 3 and 4, and compression springs 6 distributed around the circumference of the flanges 3 and 4 for normally urging flanges 3 and 4 apart.

Flange 4 constitutes a first connecting flange connected to the pump outlet conduit, whereas flange 14 constitutes a second connecting flange. The seal-tight conduit joint between the pump outlet conduit and the outflow conduit 15 is established by pressing the first and second connecting flanges 4, 14 into seal-tight engagement with each other.

Figure 1:
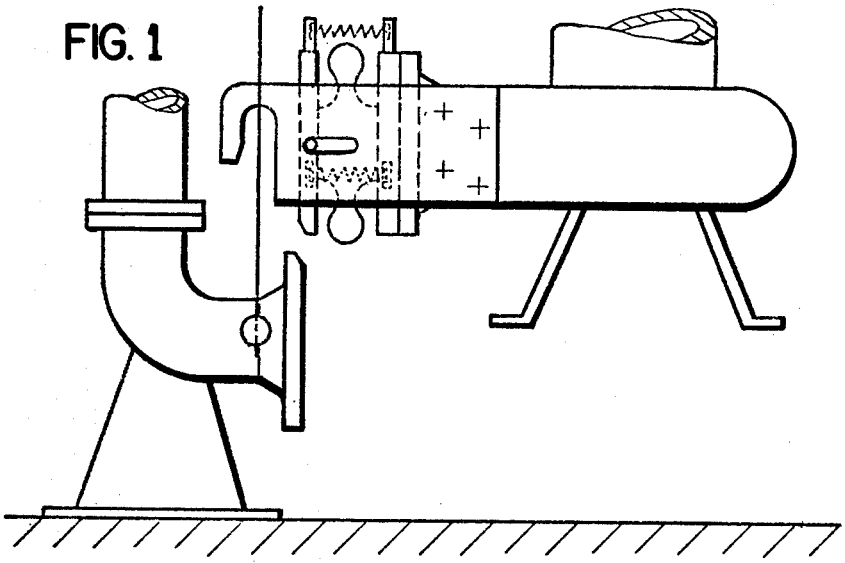
FIG. 1 depicts an underwater pumping arrangement according to the invention, as the submersible motor-driven pump is being lowered into the predetermined position.

It will be noted that the first connecting flange 4 is provided with guide pins 7 which pass through guide slots 8 in the holding plates 9. When the pump, as shown in FIG. 1, has not yet been lowered into the predetermined position, the compression springs 6 press the flange 4 away from the flange 3. The length of the guide slot 8 determines the extent to which the flange 4 can be pushed. In the illustrated embodiment, when the pump 2 is in the illustrated predetermined position of FIG. 1, the expandable-contractable connecting chamber of FIG. 3 has a certain installed-condition length. However, the length of slit 8 is such that, before the pump is lowered into the predetermined position, the length of expandable-contractable connecting chamber is somewhat greater than the installed-condition length. Also, the lower peripheral portion of first connecting flange 4 and the upper peripheral portion of second connecting flange 14 are complementarily chamfered. As the pump 2 is lowered under the guidance of the guide means 13, the complementary chamfered portions will engage each other, and the first connecting flange 4 will as it descends be pushed back against the force of compression springs 6. This makes for a relatively gradual establishment of register between the two connecting flanges, and also causes the facing surfaces of the connecting flanges to rub each other clean during their relative motion; this is of course important since the presence of dirt or the like intermediate these facing surfaces could make a seal-tight conduit joint impossible to establish.

As soon as the pump 2 is activated and begins to operate, the output pressure generated in the pump outlet conduit will cause the length of the connecting bellows to increase. The reaction force which develops as a result of this action pushes the pump 2 away from the second connecting flange 14 by a small distance, until this pushing away is terminated by the engagement of the surface 17 of claws 10 on the engagement pins 10. Meanwhile, the bellows 5 causes the first connecting flange 4 to be pressed into seal-tight engagement with the second connecting flange 14, thereby establishing the seal-tight conduit joint between the outlet conduit of pump 2 and the outflow conduit 15.

Figure 3:
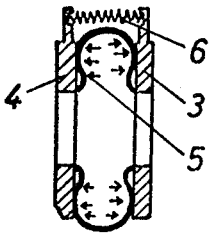
FIG. 3 depicts the connecting bellows.

In the illustrated embodiment, it is the pump outlet conduit, not the outflow conduit 15, which is provided with the expandable-contractable connecting chamber of FIG. 3. However, the relationship in principle could be reversed, although the illustrated relationship is preferred. In principle an expandable-contractable connecting chamber other than a connecting bellows could be employed.

It will be understood that each of the elements described above, or two or more together, may also find a useful application in other types of constructions differing from the types described above.

While the invention has been illustrated and described as embodied in an underwater pumping arrangement adapted to operate at the bottom of a liquid-filled container or pit, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An underwater pumping arrangement of the type including a submersible pump having a pump outlet conduit provided with a first connecting flange adapted to register with a second connecting flange of an outflow conduit permanently provided at the bottom of a liquid-filled pit or container so as to form with the second connecting flange a seal-tight conduit joint, and being of the type in which the pump as it is lowered into the liquid-filled pit or container towards the bottom thereof is guided by guiding means into a predetermined position in which the first connecting flange registers with the second connecting flange, the arrangement including supporting means at the underside of the pump for directly supporting the pump upon the bottom of the pit or container when the pump has been lowered into the predetermined position, and one of the conduits being provided with an expandable-contractable connecting chamber connected to one connecting flange and activatable for pressing the one connecting flange into seal-tight engagement with the other connecting flange to form the seal- tight conduit joint, whereby by virtue of the provision of the expandable-contractable connecting chamber and the supporting means there is established between the first and second connecting flanges a seal-tight engagement whose effectiveness is not mainly dependent upon the inherent weight of the pump itself, wherein the expandable-contractable connecting chamber assumes a certain installed-condition length when the connecting chamber is activated and maintains the connecting flanges pressed together, and further including biasing means operative for urging the connecting chamber and the one connecting flange connected thereto in direction towards the other connecting flange and operative when the pump is not yet in the predetermined position for urging the expandable-contractable connecting chamber into a position in which its length exceeds the installed-condition length by a predetermined distance, and further wherein the lower peripheral portion of the first connecting flange and the upper peripheral portion of the second connecting flange are complementarily chamfered so that upon lowering of the pump into the predetermined position the chamfered portions engage each other causing the one connecting flange to be pushed back against the force of the biasing means by the other connecting flange, wherein the expandable-contractable connecting chamber is connected at one end of the connecting flange, and further including an additional flange connected to the other end of the connecting chamber and connected to the conduit provided with the connecting chamber, and where-in said biasing means comprises a plurality of compression springs located intermediate the one connecting flange and the additional flange and distributed around the periphery of the conduit provided with the connecting chamber.

2. An underwater pumping arrangement of the type including a submersible pump having a pump outlet conduit provided with a first connecting flange adapted to register with a second connecting flange of an outflow conduit permanently provided at the bottom of a liquid-filled pit or container so as to form with the second connecting flange a seal-tight conduit joint, and being of the type in which the pump as it is lowered into the liquid-filled pit or container towards the bottom thereof is guided by guiding means into a predetermined position in which the first connecting flange registers with the second connecting flange, the arrangement including supporting means at the underside of the pump for directly supporting the pump upon the bottom of the pit or container when the pump has been lowered into the predetermined position, and one of the conduits being provided with a fluid-activated expandable-contractable connecting chamber connected to one connecting flange and activatable for pressing the one connecting flange into seal-tight engagement with the other connecting flange to form the seal-tight conduit joint and deactivatable for ceasing such pressing to disestablish the seal-tight conduit joint so that the submersible pump may again be raised out of the pit or container, whereby by virtue of the proivision of the expandable-contractable connecting chamber and the supporting means there is established between the first and second connecting flanges a seal-tight engagement whose effectiveness is not mainly dependent upon the inherent weight of the pump itself, wherein the expandable-contractable connecting chamber is a connecting bellows connected to one connecting flange and automatically operative in response to the force of the pressure generated by the pump when the pump is activated for pressing the one connecting flange against the other connecting flange to form the seal-tight conduit joint.

3. The arrangement defined in claim 2, wherein the pump outlet conduit is the one of the conduits which is provided with the expandable-contractable connecting chamber, and wherein the expandable-contractable connecting chamber is connected to the first connecting flange.

4. The arrangement defined in claim 2, wherein the expandable-contractable connecting chamber assumes a certain installed-condition length when the connecting chamber is activated and maintains the connecting flanges pressed together, and further including biasing means operative for urging the connecting chamber and the one connecting flange connected thereto in direction towards the other connecting flange and operative when the pump is not yet in the predetermined position for urging the expandable-contractable connecting chamber into a position in which its length exceeds the installed-condition length by a predetermined distance, and further wherein the lower peripheral portion of the first connecting flange and the upper peripheral portion of the second connecting flange are complementarily chamfered so that upon lowering of the pump into the predetermined position the chamfered portions engage each other causing the one connecting flange to be pushed back against the force of the biasing means by the other connecting flange.

5. The arrangement defined in claim 2, further including holding means operative for holding the two conduits together when the expandable-contractable connecting chamber is activated, whereby to prevent the connection chamber from pushing the pump outlet conduit away from the outflow conduit during the pressing together of the connecting flanges to form the seal-tight conduit joint.

6. The arrangement defined in claim 5, wherein the holding means comprises at least one claw on one conduit and at least one cooperating engaging member on the other conduit engageable by the associated claw.

7. The arrangement defined in claim 2, further including holding means operative for providing reaction force holding the two conduits together when the expandable-contractable connecting chamber is activated, whereby to prevent the connection chamber from pushing the pump outlet conduit away from the outflow conduit during the pressing together of the connecting flanges to form the seal-tight conduit joint.

* * * * *